US007021322B2

(12) United States Patent
Kramer et al.

(10) Patent No.: US 7,021,322 B2
(45) Date of Patent: Apr. 4, 2006

(54) WAREWASH MACHINE WITH WRAP-AROUND HOOD AND MULTI-POSITION SPLASH GUARD, AND DRIP FLANGE FOR WAREWASH MACHINE

(75) Inventors: Steven Henry Kramer, Osgood, OH (US); Thomas Alan Grueser, Donnelsville, OH (US)

(73) Assignee: Premark FEG L.L.C., Wilmington, DE (US)

( * ) Notice: Subject to any disclaimer, the term of this patent is extended or adjusted under 35 U.S.C. 154(b) by 68 days.

(21) Appl. No.: 10/745,991

(22) Filed: Dec. 25, 2003

(65) Prior Publication Data

US 2005/0145269 A1 Jul. 7, 2005

(51) Int. Cl.
*B08B 3/02* (2006.01)

(52) U.S. Cl. ..... 134/131; 134/154; 134/165; 134/183; 211/162; 312/289; 312/350; 29/592

(58) Field of Classification Search ..... 134/131, 134/182, 183, 127, 124, 154, 165; 211/162; 312/289, 350; 29/592, 428
See application file for complete search history.

(56) References Cited

U.S. PATENT DOCUMENTS 2,633,399 A * 3/1953 Haas ..... 312/289
2,719,070 A * 9/1955 Haas ..... 312/289
2,947,311 A * 8/1960 Fox et al. ..... 134/58 D
3,192,936 A * 7/1965 Devine ..... 134/183
3,221,754 A * 12/1965 Robson et al. ..... 134/68
3,310,150 A * 3/1967 Southard ..... 134/76
3,465,763 A * 9/1969 Hoffman ..... 134/154
3,612,253 A * 10/1971 Hoffman et al. ..... 198/729
3,858,595 A * 1/1975 Schultz et al. ..... 134/47
3,886,959 A 6/1975 Stott
3,985,226 A * 10/1976 Noren ..... 198/738
4,073,555 A 2/1978 Noren
4,228,813 A * 10/1980 Noren ..... 134/47
4,439,242 A * 3/1984 Hadden ..... 134/25.2
5,178,172 A 1/1993 Morley
5,329,952 A * 7/1994 Kojima et al. ..... 134/133
5,549,759 A 8/1996 Lithander
5,630,438 A * 5/1997 Hoover et al. ..... 134/201
5,893,381 A 4/1999 Terui
5,899,215 A 5/1999 Parker, III et al.
5,904,162 A * 5/1999 Ferguson et al. ..... 134/25.2
5,983,908 A 11/1999 Bradley
6,112,754 A 9/2000 Bradley
6,684,607 B1 * 2/2004 Ng et al. ..... 53/426

FOREIGN PATENT DOCUMENTS

DE 26 06 778 * 6/1977

* cited by examiner

*Primary Examiner*—Frankie L. Stinson
(74) *Attorney, Agent, or Firm*—Thompson Hine LLP

(57) ABSTRACT

A warewash machine includes a multi-position splash guard enabling multiple machine configurations in which undesired overspray is reduced or eliminated. A drip flange may also be provided to increase the amount of water that impinges upon wares.

20 Claims, 7 Drawing Sheets

WAREWASH MACHINE WITH WRAP-AROUND HOOD AND MULTI-POSITION SPLASH GUARD, AND DRIP FLANGE FOR WAREWASH MACHINE

TECHNICAL FIELD

The present application relates generally to machines used to wash kitchen wares such as dishes, glasses, utensils and pots and pans, and more particularly to a warewash machine with a wrap-around splash hood and multi-position splash guard and/or a warewash machine with a top-located drip flange.

BACKGROUND

In upright-type warewash machines two basic models are provided, namely a slide thru configuration for mounting along a wall or a right angle configuration for mounting in a corner. In upright-units using a wrap-around hood unit either three sides of the wash area are opened when the hood is raised, enabling the unit to be mounted either against a wall or in a corner. However, when mounted against a wall raising of the hood exposed the operator to undesired overspray and when mounted in a corner raising of the hood exposed the wall to undesired overspray. In corner installations it is known to mount a wall panel against the wall in attempt to protect the wall. However, overspray can still drip down to lower parts of the wall or onto the floor, and the problem of operators getting wet still remains an issue in installations along a wall. Accordingly, it would be desirable to provide a warewash machine system using a wrap-around hood in which overspray through an essentially unused side of the machine can be effectively reduced or eliminated.

Warewash machines may also include overhead wash arms or rinse arms that tend to leak water in a manner that such water does not impinge on wares within the wash area. It would be desirable to provide a system for directing such leakage water onto wares.

SUMMARY

In one aspect, a warewash machine includes a frame in part defining a multi sided wash area. A wrap-around hood unit includes first, second and third wall portions, the wrap-around hood unit movable between a closed position, in which the first, second and third wall portions are located in alignment with first, second and third sides of the wash area, and an open position to provide access to the wash area. A multi-position splash guard is sized and configured for selective mounting in multiple positions on the warewash machine enabling multiple machine configurations, including: (i) a first configuration in which, when the wrap-around hood is in its open position, the multi-position splash guard is located alongside the first side of the wash area and the second and third sides of the wash area are open to provide inlet and outlet of wares; and (ii) a second configuration in which, when the wrap-around hood is in its open position, the multi-position splash guard is located alongside second side of the wash area and the first and third sides of the wash area are open to provide inlet and outlet of wares.

In another aspect, a warewash machine includes a frame in part defining a four-sided wash area, a first side of the wash area covered by a wall. A wrap-around hood is movable between a lowered position and a raised position on the frame. A multi-position splash guard is sized and configured for selective mounting in multiple positions on the frame enabling multiple machine configurations, including: (i) a first configuration in which the multi-position splash guard is mounted to the frame along a second side of the wash area so as to limit overspray through the second side of the wash area even when the wrap-around hood is in its raised position, with third and fourth sides of the wash area being open to provide inlet and outlet of wares when the wrap-around hood is in its raised position; and (ii) a second configuration in which the multi-position splash guard is mounted to the frame along the third side of the wash area so as to limit overspray through the third side of the wash area even when the wrap-around hood is in its raised position, with the second and fourth sides of the wash area being open to provide inlet and outlet of wares when the wrap-around hood is in its raised position.

In a further aspect, a multi-position splash guard is installable on a warewash machine including a frame in part defining a multi-sided wash area and a wrap-around hood movable between a lowered position to align with first, second and third sides of the wash area and a raised position to provide access to the wash area. The multi-position splash guard includes a wall member sized and configured for selective mounting in at least two positions on the warewash machine, including a first position in which the wall member limits overspray through a second side of the wash area, and a second position in which the wall member limits overspray through the third side of the wash area.

In yet another aspect, a method of manufacturing a warewash machine in one of at least first and second configurations involves the steps of: providing a wash unit with a wash area with at least first, second and third substantially vertical sides; providing a movable wrap-around hood with first, second and third wall portions, when the wrap-around hood is in a closed position the first, second and third wall portions are respectively positioned alongside the first, second and third substantially vertical sides, when the wrap-around hood is in an open position the first, second and third wall portions are respectively offset from the first, second and third substantially vertical sides; making a determination of whether the warewash machine shall have the first configuration or the second configuration; and (i) if the determination is made that the warewash machine shall have the first configuration, mounting a splash guard at a first position on the warewash machine to limit overspray through the first side of the wash area when the wrap-around hood is in the open position; and (ii) if the determination is made that the warewash machine shall have the second configuration, mounting a splash guard at a second position on the warewash machine to limit overspray through the second side of the wash area when the wrap-around hood is in the open position.

In a further aspect, a warewash machine includes a wash area defined by a housing structure and including a top side having a rotatable rinse arm with a coupling to a water source. A drip flange extends downward from the top side, the drip flange spaced from and extending around the coupling so that leakage water that is directed laterally outward from the coupling impinges on the drip flange and drains downward onto wares within the wash area.

DETAILED DESCRIPTION

Figure 1:
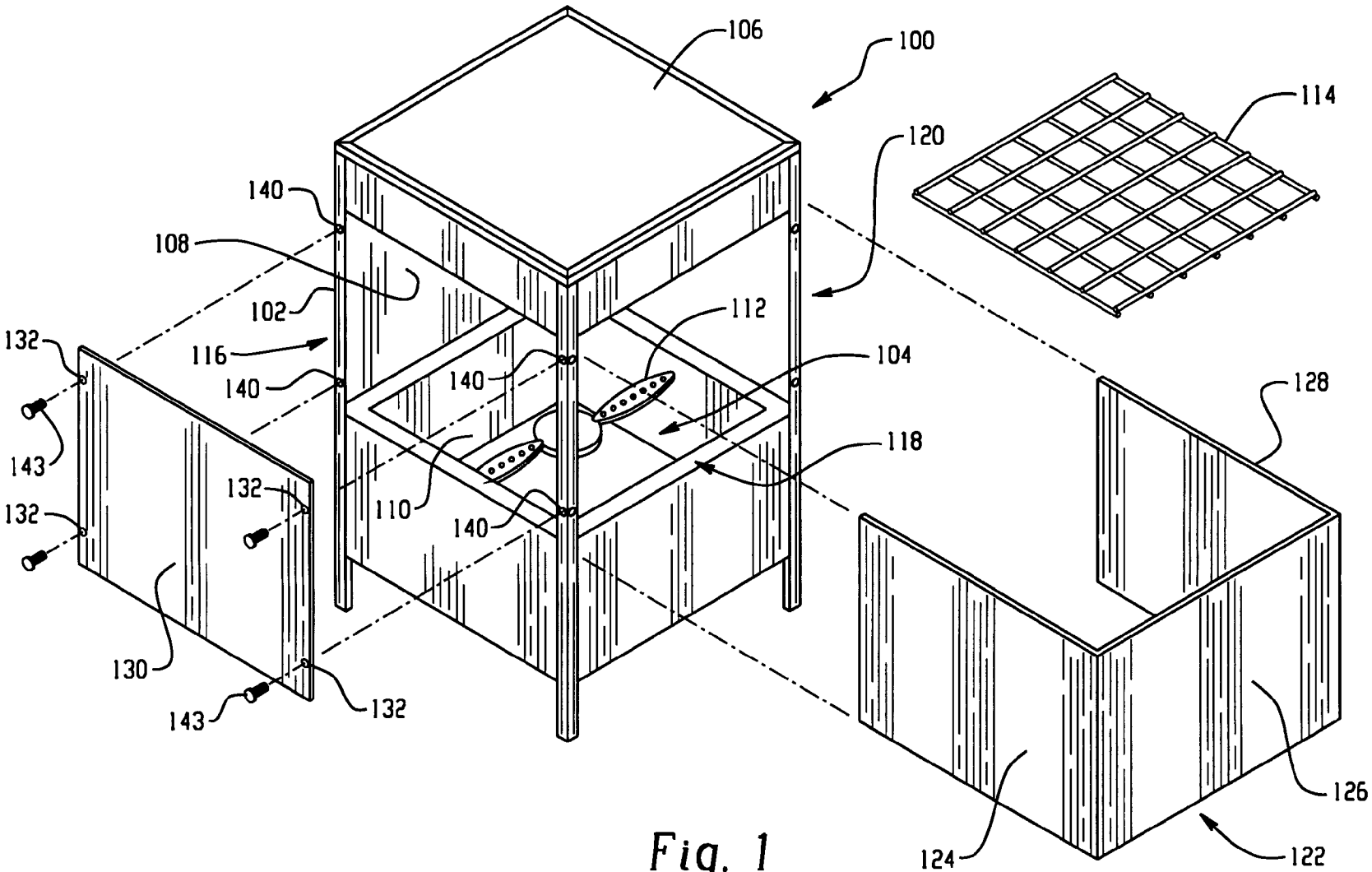
FIG. 1 is perspective view of one embodiment of a warewash machine with a multi-position splash guard.

Referring to FIG. 1, one embodiment of a warewash machine 100 is shown in partially disassembled configuration. A frame/housing 102 in part defines a multi-sided wash area 104. The machine includes a fixed top part 106 and a fixed rear wall 108. A lower tub 110 may fully or partially encompass the bottom of the wash area 104, and a lower wash arm 112 is provided for directing liquid onto wares. A separate rinse arm may also be provided, and both a wash arm and rinse arm may also be provided at the top side of the wash area 104. A grate 114 may be positioned atop the tube area for supporting a rack of dishes during a wash cycle.

The frame 102 is formed to enable three substantially vertical sides 116, 118 and 120 to be open for easy access to the wash area. During a wash cycle, a wrap-around hood 122 is positioned with its three wall parts 124, 126 and 128 in alignment with respective sides 116, 118 and 120 (sides 116 and 120 oppose each other and are spaced apart as shown, while sides 116 and 118, and similarly sides 118 and 120, are adjacent each other). Such positioning of the hood 122 is considered the closed position of the hood. As used herein, the terminology "in alignment with" shall not be construed to require that the wall parts be directly centered on the sides of the wash area, although such a configuration is possible and within the scope of such terminology. The hood may typically raised to an upward, open position (see FIGS. 2–4) in which the three wall parts 124, 126 and 128 of the hood 122 are offset from the sides 116, 118 and 120, leaving such sides open unless otherwise covered. In this regard, the illustrated warewash machine 100 includes a multi-position splash guard 130 sized and configured for selective mounting in multiple positions on the warewash machine, particularly on the frame 102 adjacent any of sides 116, 118 or 120. This ability to position the splash guard at such multiple locations enables multiple machine configurations as shown in FIGS. 2–4.

Figure 2:
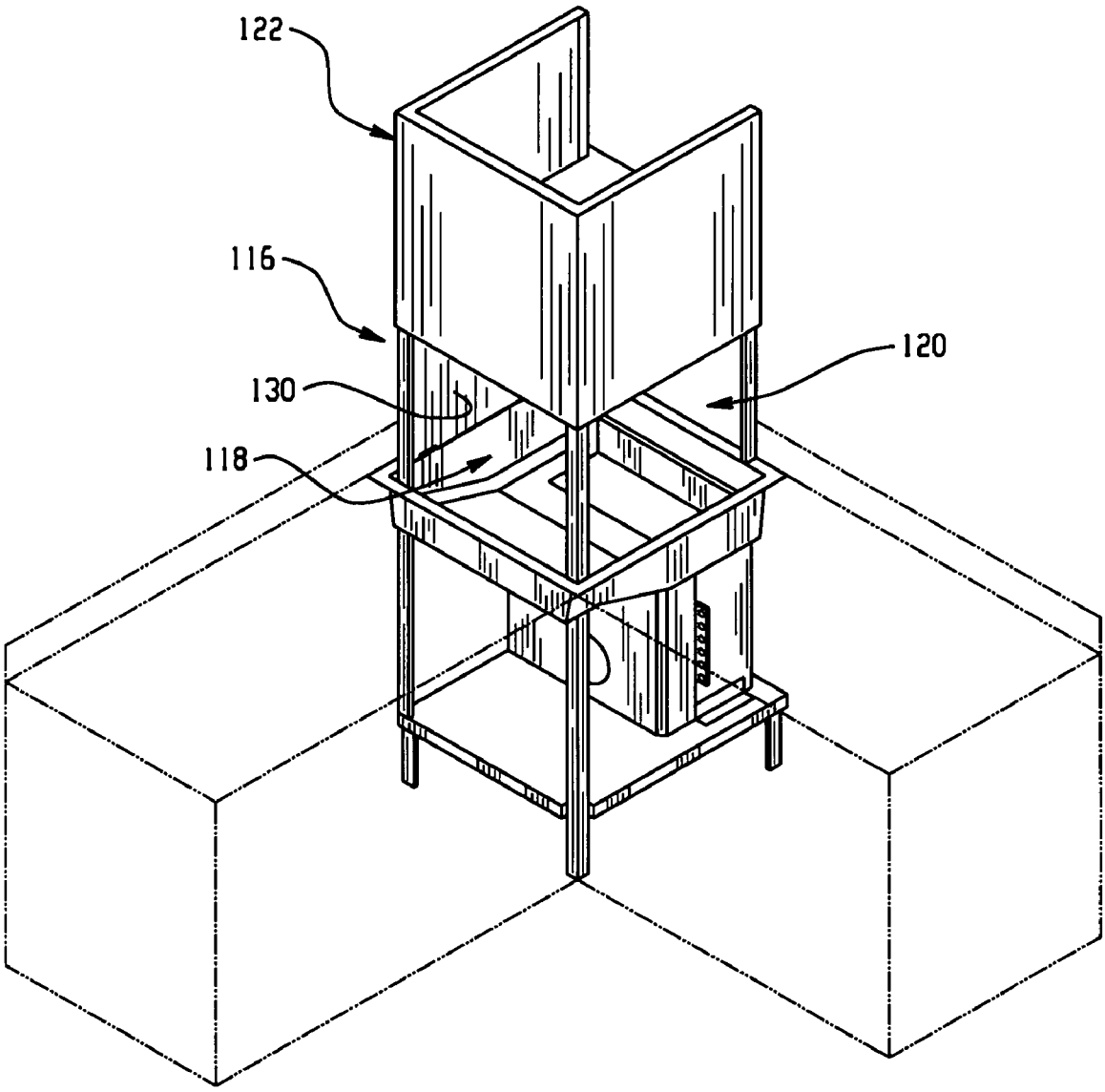
FIGS. 2–4 depict respective warewash machine configurations using a multi-position splash guard.

In particular, in one configuration shown in FIG. 2 the multi-position splash guard 130 is located alongside side 116 of the wash area. When the wrap-around hood 122 is in its open position sides 118 and 120 of the wash area are open to provide inlet and outlet of wares, while the guard 130 prevents overspray through side 116. In another configuration shown in FIG. 3, the multi-position splash guard 130 is located alongside side 118 of the wash area. When the wrap-around hood 122 is in its open position sides 116 and 120 of the wash area are open to provide inlet and outlet of wares, while the guard 130 prevents overspray through side 118. In still another configuration shown in FIG. 4, the multi-position splash guard 130 is located alongside side 120 of the wash area. When the wrap-around hood 122 is in its open position sides 116 and 118 of the wash area are open to provide inlet and outlet of wares, while the guard 130 prevents overspray through side 120. In each of the configurations of FIGS. 2–4, the splash guard is positioned to limit overspray of liquid out of a particular side of the wash area, even when the wrap-around hood 122 is in the open position. Further, in each configuration, when the wrap-around hood is lowered to its closed position, the two open sides of the wash area are walled off by respective wall parts of the hood, and the other wall part of the hood covers the multi-position splash guard.

Figure 3:
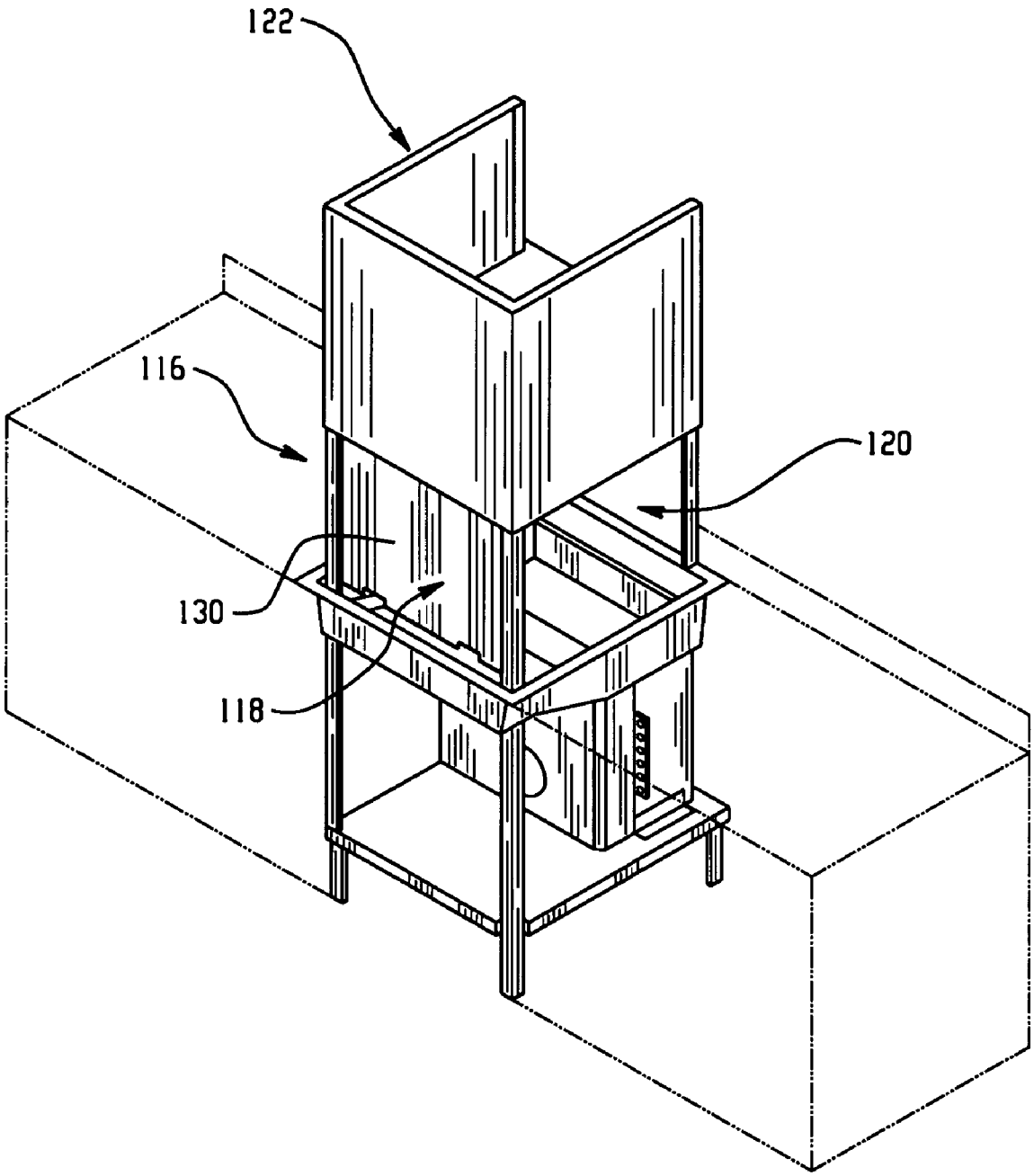
Figure 4:
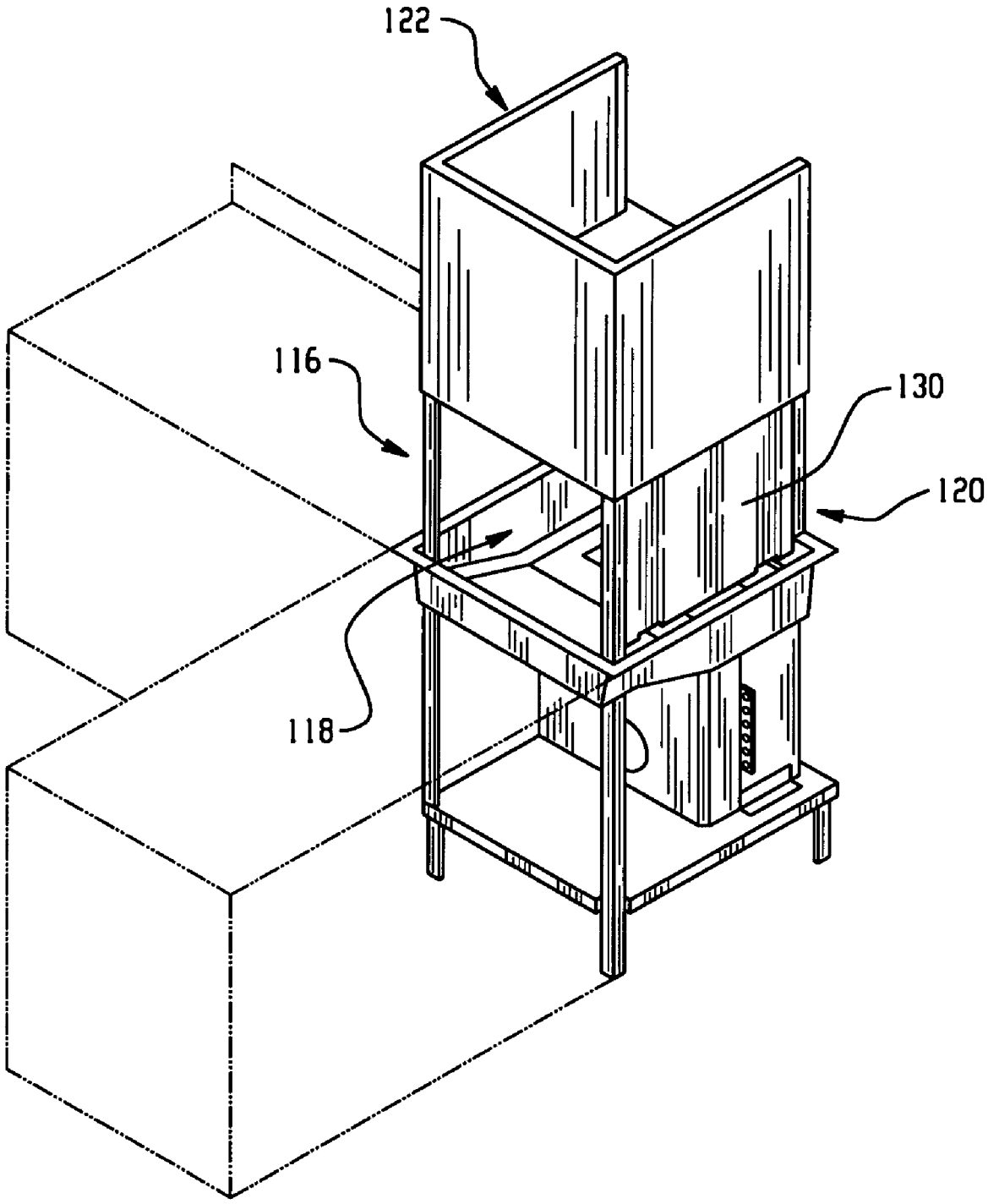

In each configuration of FIGS. 2–4, upon installation the lower edge of each of the inlet and outlet sides of the wash area are typically located at a height aligned with a countertop or conveyor as shown, enabling one counter or conveyor to be used as a staging area for ware racks prior to washing, and allowing the other counter or conveyor to be used as a receiving area for ware racks removed from the machine after washing. In the configuration of FIGS. 2 and 4, the side of the wash area that includes the multi-position splash guard 130 can be positioned adjacent a wall, as is common in a corner installation, without concern that overspray will damage the wall. In the configuration of FIG. 3 the machine can be positioned along a wall without concern that an operator located at side 118 of the machine will be sprayed with water when the operator raises the hood to move ware racks out and into the wash area.

Figure 5:
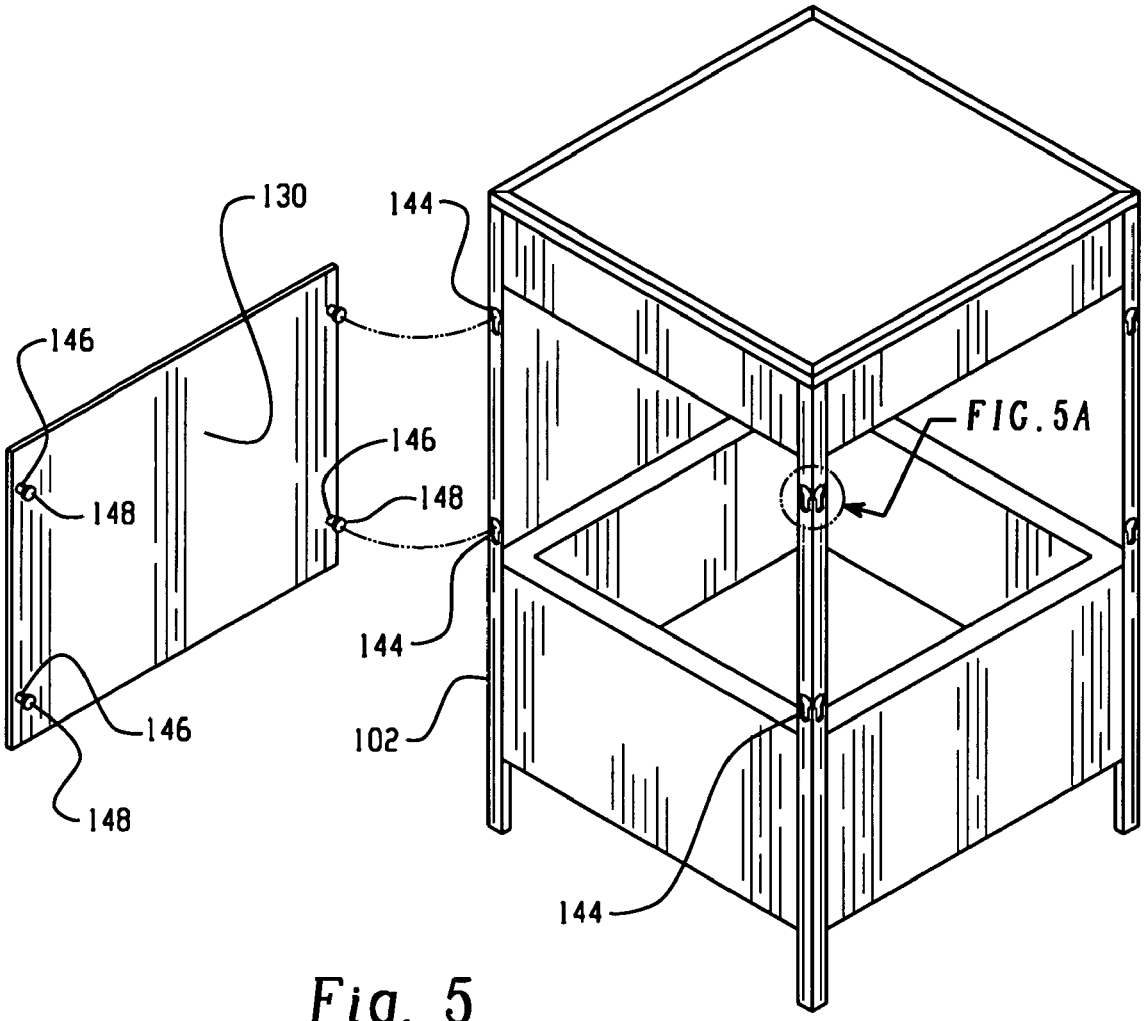
FIG. 5 is a partial perspective showing one variation for attachment of a multi position splash guard.
Figure 5A:
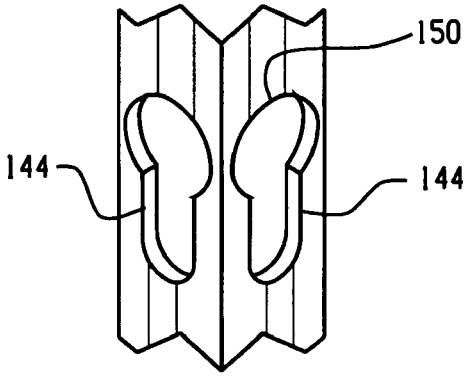
Figure 6:
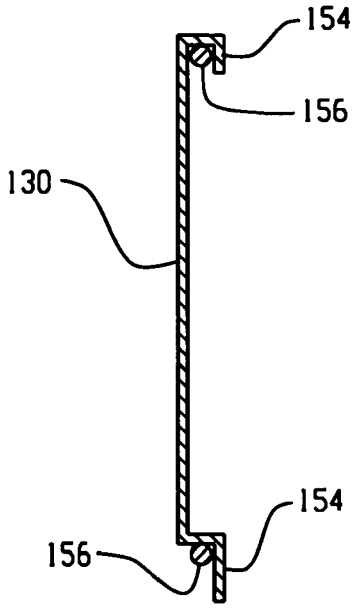
FIG. 6 is a side elevation (in cross-section) showing another variation for attachment of a multi-position splash guard.
Figure 7:
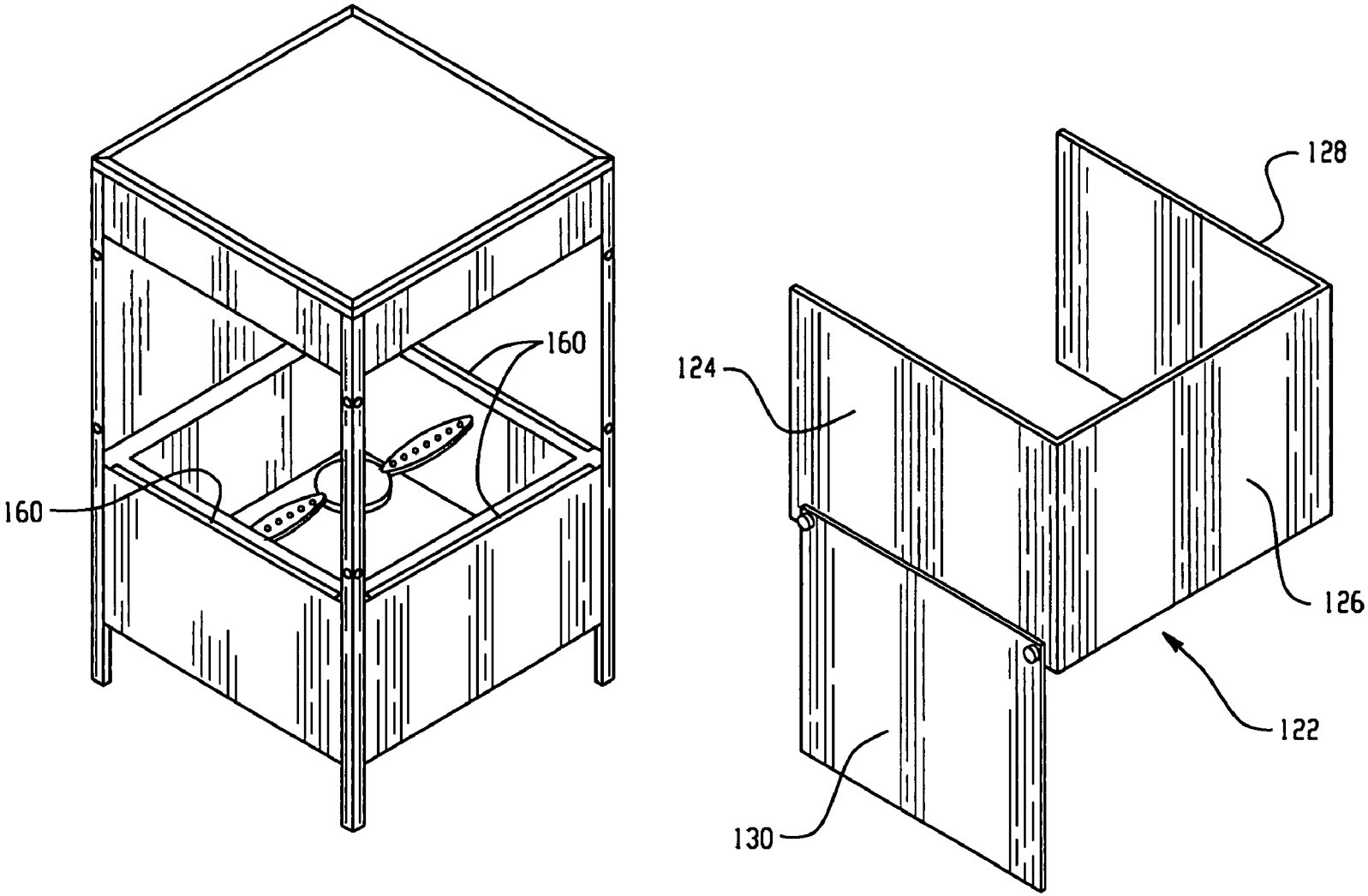
FIG. 7 is a partial perspective showing an alternative embodiment where a multi-position splash guard connects with the wrap-around hood.

In the illustrated embodiment of FIGS. 2–4, the multi-position splash guard 130 mounts directly to the frame 102 of the warewash machine. In one variation, shown in FIG. 2, the frame 102 includes fastener openings 140 to facilitate attachment of the multi-position splash guard 130, which includes fastener openings 142 alignable with the fastener openings 140 of the frame. A fastener 143, such as a screw, bolt or pin, is then positioned through the aligned openings 140 and 142 to hold the splash guard 130 in place. All three sides 116, 118 and 120 of the frame include similarly arranged openings 140 to facilitate selective attachment of the multi-position splash guard on any of the three sides. In another embodiment, shown in the partial view of FIG. 5, the frame 102 includes mount slots 144 to facilitate attachment of the multi-position splash guard 130, which includes mount studs 146 extending therefrom and alignable with the mount slots 144 of the frame 102. The studs 146 may have an enlarged heads 148 to prevent removal of the guard unless the guard is first moved upward to position the enlarged heads in enlarged slot parts 150. Alternatively, the mount studs 146 could be located on the frame 102 and the slots 144 could be located in the multi-position splash guard 130. In still another variation, the splash guard could be formed with bent upper and lower portions 154, as shown in the partial side elevation of FIG. 6, which fit over support rods 156 on the frame. Alternatively, the sides 116, 118 and 120 of the frame could be configured with spaced apart slots into which the guard could slide. Combinations of these attachment schemes could also be used. In any case, a bottom part of the multi-position guard may be located to direct liquid back into the wash area, in each of the mounting positions, and in some implementations will include an inwardly extending lip to carry out this purpose.

In an alternative embodiment, the multi-position splash guard 130 may be connected to any of the three wall parts 124, 126 and 128 of the wrap-around hood. In one variation, shown in the partial view of FIG. 8, the multi-position splash guard 130 is attached to and moves with the hood 122. The lower part of the frame or housing of the machine includes a guard receiving compartment, such as 160, on each side. The guard 130 moves into the compartment on the side to which it is attached when the wrap-around hood is lowered, and moves out of the compartment along the side of the wash area, for overspray protection, when the hood is raised. In another variation, the internal side of each of the wall parts of the wrap-around hood may include spaced apart channels to receive the guard, and the wrap-around hood 122 may move relative to the multi-position splash guard 130 when the wrap-around hood is moved between its lowered position and its raised position.

Regardless of the embodiment use, a method of manufacturing a warewash machine in one of at least first and second configurations is provided, and involves the steps of providing a wash unit with a wash area with at least first, second and third substantially vertical sides; providing a movable wrap-around hood with first, second and third wall portions, when the wrap-around hood is in a closed position the first, second and third wall portions are respectively positioned alongside the first, second and third substantially vertical sides, when the wrap-around hood is in an open position the first, second and third wall portions are respectively offset from the first, second and third substantially vertical sides; making a determination of whether the warewash machine shall have the first configuration or the second configuration; and (i) if the determination is made that the warewash machine shall have the first configuration, mounting a splash guard at a first position on the warewash machine to limit overspray through the first side of the wash area when the wrap-around hood is in the open position and (ii) if the determination is made that the warewash machine shall have the second configuration, mounting a splash guard at a second position on the warewash machine to limit overspray through the second side of the wash area when the wrap-around hood is in the open position.

In another aspect, rather than provide a multi-position splash guard, a warewash machine may be constructed with a wrap-around hood with wall portions, that are selectively disconnectable from the wrap-around hood so as to remain in the lowered position when the wrap-around hood is moved to its raised position, again enabling selectable machine configurations, depending upon which wall is disconnected to remain lowered and limit overspray. In one example a bracket connecting two wall portions is fixed to one wall but is selectively connectable to the other wall by a spring-loaded latch on the inner side of the other wall.

Figure 8:
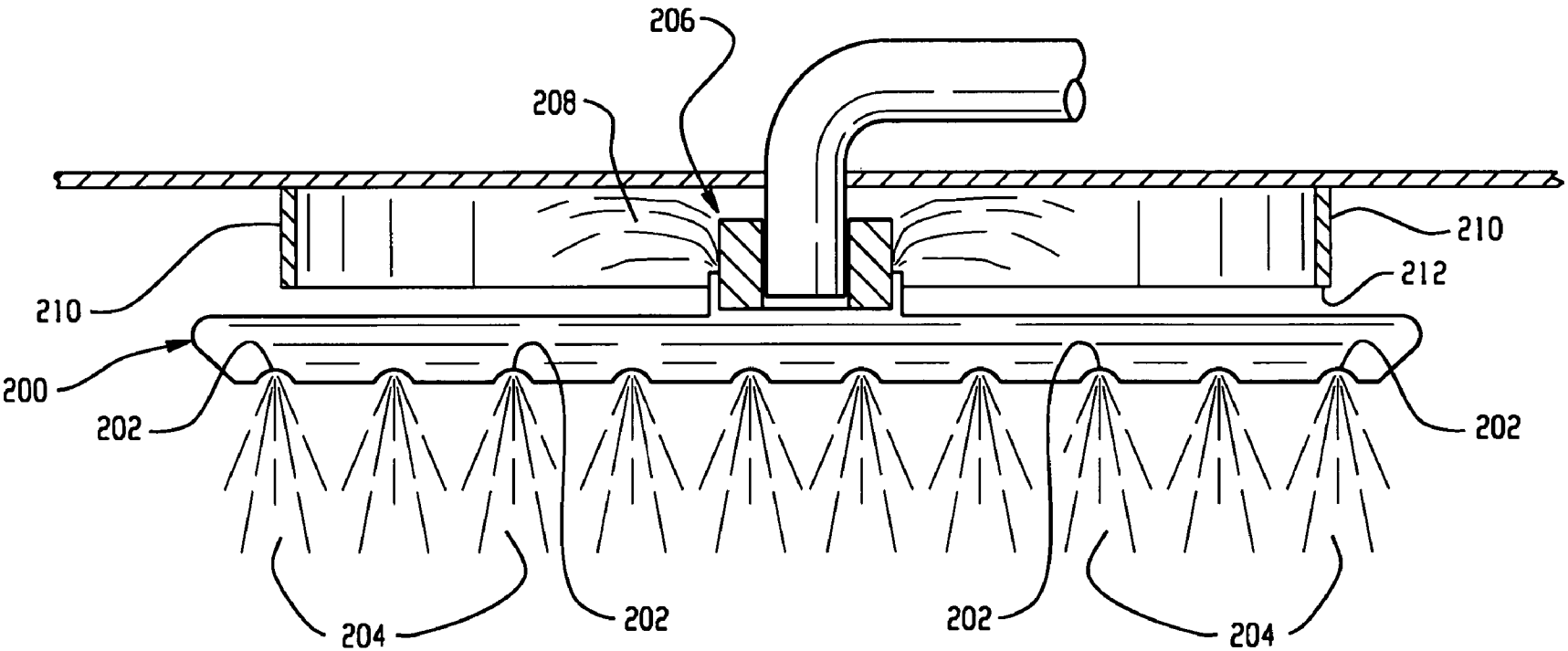
FIG. 8 is a side view of an upper part of a wash chamber including a drip flange.

In addition to limiting overspray from warewash machines, it is also desirable to direct as much water as possible onto wares within the wash chamber. Referring to FIG. 8, a top part of the wash chamber is shown including liquid dispensing arm 200 having a plurality of nozzles 202 thereon for ejecting liquid 204 downward onto wares. The arm 200 is mounted for rotation as water is ejected from the nozzles, and therefore a moving coupling to a water source is created in area 206. Liquid tends to leak from coupling area 206 as shown at 208 and is ejected radially outward, and such liquid 208 typically moves to the sides of the wash chamber without ever reaching the wares. As it is desirable to maximize delivery of water to the wares, a drip flange 210 is incorporated, extending downward from the top side of the wash area. The drip flange 210 is spaced from and extends around the coupling area 206 so that leakage water 208 that is directed radially or laterally outward from the coupling impinges on the drip flange 210 and drains downward onto wares within the wash area. In one variation, the drip flange 210 is continuous around the coupling area 206, and may extend in a circle around the coupling area 206. As shown, liquid dispensing arm 200 includes ends which extend outward past a lower edge 212 of the drip flange 210, and a clearance is provided between the rotatable arm and the lower edge of the drip flange, however, in another embodiment the flange extends substantially the entire distance from the top side or ceiling of the wash area just to the top of the rotating arm to capture as much of the leakage water as possible. The drip flange may be configured to prevent a substantial portion of leakage water 208 from being directed onto side walls of the wash area. In one implementation, at least seventy-five percent (75%) of leakage water from the coupling area impinges upon the drip flange.

It is to be clearly understood that the above description is intended by way of illustration and example only and is not intended to be taken by way of limitation. Other changes and modifications could be made, including both narrowing and broadening variations of the previously described embodiments and examples.

The invention claimed is:

1. A warewash machine, comprising:

a frame in part defining a multi-sided wash area;

a wrap-around hood unit including first, second and third wall portions, the wrap-around hood unit movable between a closed position, in which the first, second and third wall portions are located in alignment with first, second and third sides of the wash area, and an open position to provide access to the wash area;

a multi-position splash guard sized and configured for selective mounting in multiple positions on the warewash machine enabling multiple machine configurations, including:

a first configuration in which, when the wrap-around hood is in its open position, the multi-position splash guard is located alongside the first side of the wash area and the second and third sides of the wash area are open to provide inlet and outlet of wares; and a second configuration in which, when the wrap-around hood is in its open position, the multi-position splash guard is located alongside second side of the wash area and the first and third sides of the wash area are open to provide inlet and outlet of wares.

2. The warewash machine of claim 1 wherein the first and second sides are substantially parallel to each other.

3. The warewash machine of claim 1 wherein the first and second sides are adjacent to each other.

4. The warewash machine of claim 1 wherein the multi-position splash guard is sized and configured for selective mounting in multiple positions on the frame.

5. The warewash machine of claim 1 wherein the multi-position splash guard is sized and configured for selective mounting in multiple positions on the wrap-around hood unit.

6. The warewash machine of claim 5 wherein the frame includes a first guard receiving compartment and a second guard receiving compartment, wherein in the first configuration the multi-position splash guard moves into the first guard receiving compartment when the wrap-around hood is moved into its closed position and moves upward along the second side of the wash area when the wrap-around hood is moved into its open position, wherein in the second configuration the multi-position splash guard moves into the second guard receiving compartment when the wrap-around hood is moved into its closed position and moves upward along the third side of the wash area when the wrap-around hood is moved into its open position.

7. The warewash machine of claim 5 wherein in both the first configuration and the second configuration the wrap-around hood moves relative to the multi-position splash guard when the wrap-around hood is moved between its closed position and its open position.

8. The warewash machine of claim 1 wherein the multi-sided wash area includes a top wall, a rotatable rinse arm proximate the top wall and having a coupling to a water source, and a drip flange extending downward from the top wall, the drip flange spared from and extending around the coupling so that leakage water that is directed laterally outward from the coupling impinges on the drip flange and drips downward.

9. A warewash machine, comprising:

a frame in part defining a four-sided wash area, a first side of the wash area covered by a wall;

a wrap-around hood movable between a lowered position and a raised position on the frame;

a multi-position splash guard sized and configured for selective mounting in multiple positions on the frame enabling multiple machine configurations, including:

a first configuration in which the multi-position splash guard is mounted to the frame along a second side of the wash area so as to limit overspray through the second side of the wash area even when the wrap-around hood is in its raised position, with third and fourth sides of the wash area being open to provide inlet and outlet of wares when the wrap-around hood is in its raised position; and a second configuration in which the multi-position splash guard is mounted to the frame along the third side of the wash area so as to limit overspray through the third side of the wash area even when the wrap-around hood is in its raised position, with the second and fourth sides of the wash area being open to provide inlet and outlet of wares when the wrap-around hood is in its raised position.

10. The warewash machine of claim 9 wherein the multiple machine configurations further include:

a third configuration in which the multi-position splash guard is mounted to the frame along the fourth side of the wash area so as to limit overspray through the fourth side of the wash area even when the wrap-around hood is in its raised position, with the second and third sides of the wash area being open to provide inlet and outlet of wares when the wrap-around hood is in its raised position.

11. The warewash machine of claim 9 wherein, in both the first configuration and the second configuration, the wrap-around hood, when in its lowered position, covers the multi-position splash guard.

12. The warewash machine of claim 9 wherein the frame includes fastener openings in both the second side and third side to facilitate attachment of the multi-position splash guard, which includes fastener openings alignable with the fastener openings of the frame.

13. The warewash machine of claim 9 wherein the frame includes mount slots in both the second side and the third side to facilitate attachment of the multi-position splash guard, which includes mount studs alignable with the mount slots of the frame.

14. The warewash machine of claim 9 wherein the frame includes mount studs in both the first side and second side to facilitate attachment of the multi-position splash guard, which includes mount slots alignable with the mount studs of the frame.

15. The warewash machine of claim 9 wherein in the first configuration the multi-position splash guard is attached to one side of the wrap-around hood and in the second configuration the multi-position splash guard is attached to another side of the wrap-around hood.

16. A multi-position splash guard installable on a warewash machine including a frame in part defining a multi-sided wash area and a wrap-around hood movable between a lowered position to align with first, second and third sides of the wash area and a raised position to provide access to the wash area, the multi-position splash guard comprising:

a wall member sized and configured for selective mounting in at least two positions on the warewash machine, including a first position in which the wall member limits overspray through a second side of the wash area, and a second position in which the wall member limits overspray through the third side of the wash area.

17. A method of manufacturing a warewash machine in one of at least first and second configurations, comprising:

providing a wash unit with a wash area with at least first, second and third substantially vertical sides;

providing a movable wrap-around hood with first, second and third wall portions, when the wrap-around hood is in a closed position the first, second and third wall portions are respectively positioned alongside the first, second and third substantially vertical sides, when the wrap-around hood is in an open position the first, second and third wall portions are respectively offset from the first, second and third substantially vertical sides;

making a determination of whether the warewash machine shall have the first configuration or the second configuration; and if the determination is made that the warewash machine shall have the first configuration, mounting a splash guard at a first position on the warewash machine to limit overspray through the first side of the wash area when the wrap-around hood is in the open position;

if the determination is made that the warewash machine shall have the second configuration, mounting a splash guard at a second position on the warewash machine to limit overspray through the second side of the wash area when the wrap-around hood is in the open position.

18. A warewash machine, comprising:

a frame in part defining a multi-sided wash area, one side of the wash area covered by a wall;

a wrap-around hood movable between a lowered position and a raised position on the frame, the wrap around hood including at least first, second and third wall portions that are respectively located alongside first, second and third sides of the wash area when the wrap-around hood is in the lowered position, at least the first and second wall portions selectively disconnectable from the wrap-around hood so as to remain in the lowered position when the wrap-around hood is moved to its raised position, enabling multiple machine configurations, including:

a first configuration in which the first wall portion is disconnected from the wrap-around hood so that, when the wrap-around hood is in its raised position, the first wall portion limits overspray through the first side of the wash area and the second and third wall portions are raised such that the second and third sides of the wash area are open to provide inlet and outlet of wares; and a second configuration in which the second wall portion is disconnected from the wrap-around hood so that, when the wrap-around hood is in its raised position, the second wall portion limits overspray through the second side of the wash area and the first and third wall portions are raised such that the first and third sides of the wash area are open to provide inlet and outlet of wares.

19. The warewash machine of claim 18 wherein first wall portion is adjacent the second wall portion.

20. The warewash machine of claim 18 wherein the first wall portion is spaced apart from and opposes the second wall portion.

* * * * *